US006375420B1

(12) United States Patent
Tanuma et al.

(10) Patent No.: US 6,375,420 B1
(45) Date of Patent: Apr. 23, 2002

(54) HIGH EFFICIENCY BLADE CONFIGURATION FOR STEAM TURBINE

(75) Inventors: Tadashi Tanuma; Taro Sakamoto, both of Kanagawa-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/361,570

(22) Filed: Jul. 27, 1999

(30) Foreign Application Priority Data

Jul. 31, 1998 (JP) ..... 10-218262

(51) Int. Cl.[7] ..... F01D 5/14

(52) U.S. Cl. ..... 415/199.5; 415/200; 416/190; 416/191; 416/223 A; 416/241 R; 416/243; 416/DIG. 2; 416/DIG. 5

(58) Field of Search ..... 415/181, 199.5, 415/200; 416/190, 191, 194, 196 R, 223 R, 223 A, 241 R, 243, DIG. 2, DIG. 5

(56) References Cited

U.S. PATENT DOCUMENTS

| | | | | |
|---|---|---|---|---|
| 2,935,246 A | | 5/1960 | Roy | |
| 4,643,645 A | | 2/1987 | Robbins et al. | |
| 5,035,578 A | * | 7/1991 | Tran | 416/223 A |
| 5,203,676 A | | 4/1993 | Ferleger et al. | |
| 5,267,834 A | | 12/1993 | Dinh et al. | |
| 5,286,168 A | | 2/1994 | Smith | |
| 5,326,221 A | * | 7/1994 | Amyot et al. | 416/223 A |
| 5,370,497 A | * | 12/1994 | Doi et al. | 415/199.5 |
| 5,393,200 A | * | 2/1995 | Dinh et al. | 416/223 A |
| 5,480,285 A | * | 1/1996 | Patel et al. | 416/223 A |
| 5,695,323 A | * | 12/1997 | Pfeifere et al. | 416/190 |

FOREIGN PATENT DOCUMENTS

| | | | | |
|---|---|---|---|---|
| GB | 2 162 587 | | 2/1986 | |
| JP | 61-4965 | | 2/1986 | |
| JP | 1-182504 A | * | 7/1989 | 416/241 R |
| JP | 6-272504 | | 9/1994 | |

OTHER PUBLICATIONS

Tanuma et al., "Aerodynamic Development of Advanced Steam Turbine Blades", PWR vol. 28, pp. 367–374, Book No. G00983, 1995.

* cited by examiner

*Primary Examiner*—Christopher Verdier
(74) *Attorney, Agent, or Firm*—Foley & Lardner

(57) ABSTRACT

A steam turbine that passes more turbine driving steam by off-setting the turbine moving blade throat-pitch ratio before operation and, when a blade untwist is generated during operation, causing more turbine driving steam to flow by maintaining an appropriate value, and, at the same time causing the turbine moving blade throat-pitch ratio to swell by giving the blade untwisting angle to the blade cross-sections in regions where the aerodynamic loss is small. The steam turbine is one in which the throat-pitch ratio (S/T) distribution of a turbine moving blade is offset by forming a curve providing at least one minimal value and maximal value by giving blade twist angle to the blade cross-sections in the blade height direction from blade root to blade tip and, at the same time, the distribution of throat-pitch ratio (S/T) taking into consideration blade untwist generated during operation.

9 Claims, 16 Drawing Sheets

HIGH EFFICIENCY BLADE CONFIGURATION FOR STEAM TURBINE

FIELD OF THE INVENTION

The present invention relates to steam turbines. In particular, the invention relates to the configuration of the turbine blades for a steam turbine.

DESCRIPTION OF THE RELATED ART

With recent turbines, there has been a tendency to use longer blades in the final turbine stage and in the turbine stages upstream of the final stage to economise on fuel and operate more efficiently.

For example, FIG. 10 shows a 700,000 kW-output class steam turbine in which long blades have been adopted in the final turbine stage and the turbine stages upstream of the final turbine stage. This is an axial flow type turbine in which multiple stages 5 are located serially in the turbine-driving steam flow along the axial direction of turbine shaft 2 that is housed in turbine casing 1. Each stage 5 comprises a set of fixed turbine nozzle blades 3, and a downstream adjacent set of turbine moving blades 4.

The turbine nozzle blades 3 of each stage are aligned in the circumferential direction around the turbine shaft 2 with their outer ends supported by an outer diaphragm 6, which is fixed in the turbine casing 1, and their inner ends supported by an inner diaphragm 7 adjacent the turbine shaft 2. A seal 7*a* carried by the inner diaphragm 7 seals inner diaphragm 7 to rotating shaft 2.

The turbine moving blades 4 of each stage are circumferentially aligned around turbine shaft 2, adjacent and downstream of the turbine nozzle blades 3 of that stage. Each turbine moving blade extends radially from the shaft 2 and has a blade embedded portion 8 embedded in the shaft 2, a blade effective portion 9 from root to tip and a blade tip connecting portion 10. The blade effective portion 9 is the part of the blade that does the actual work (generates rotational torque) when the turbine driving steam passes through the turbine moving blades.

The turbine moving blades 4 are provided with intermediate connectors 11 in the intermediate parts of the blade effective portions 9, which serve to stabilize the effective portions 9 of the entire set of blades. The intermediate connectors 11 comprise, as shown in FIG. 11, bosses 11*a* and 11*b* on the respective backs ("suction side" or "suction surface" as it is commonly called), 9*c* and 9*d*, and bellies ("pressure side" or "pressure surface" as it is commonly called), 9*e* and 9*f*, of one blade effective portion 9a and the adjacent blade effective portion 9*b*. A linking sleeve 11*c* pivotally interconnects bosses 11*a* and 11*b* via lugs (not shown) provided at both ends of bosses 11*a* and 11*b*. Thus, vibration of the intermediate portions, induced by such factors as fluctuations over time of the jet force of the turbine driving steam flowing from the turbine nozzle blades 3, and turbine shaft vibration, is suppressed to a low level.

The tips of turbine moving blades 4 are stabilized by blade tip connectors 10 which are formed, for example, as so-called "snubber type" plate-shaped extension pieces 10*a* and 10*b* integrally cut from the blade effective portion 9, as shown in FIG. 12. During operation, blade tip vibration is suppressed using the mutual contact friction of the extension pieces 10*a* and 10*b*.

The above-described arrangement of intermediate connectors 11 and blade tip connectors 10 provides effective countermeasures against vibration induced by such factors as variation over time of the turbine driving steam jet force, in turbines having long blades. However, in a prior art steam turbines (shown in FIG. 10), with long blades in which the blade effective portions 9 of the turbine moving blades 4 exceed 1 m, many other problems arise because of the blade length. One of these is that, during operation, the throat-pitch ratio (S/T) varies as a consequence of deformation of the blade warp configuration due to centrifugal force, resulting in a reduction of aerodynamic efficiency.

Attempts have been made in the prior art to address this problem by adopting the so-called "simplified three-dimensional blade design method". In this method, the cross-sectional shape of the turbine moving blade is varied to correspond to the fact that the equivalent velocity diagram had been largely changed in the height direction of the passage. However, if the turbine moving blades 4 of the steam turbine are long, as shown in FIG. 13, the inlet flow angle of the turbine driving steam relative to the turbine blade will vary greatly along the blade effective portion 9 from the blade root to the blade mean diameter (pitch circle diameter), to the blade tip.

In FIG. 13, $\alpha$ indicates the inlet flow angle of the turbine driving steam to the turbine moving blade 4, BV the turbine driving steam inlet flow speed vector flowing into the turbine moving blade 4, SV the turbine driving steam outlet flow speed vector flowing out of the turbine nozzle blades (not shown) and U the peripheral speed, respectively. Also, the subscripts R, P and T indicate the respective blade root, blade mean diameter (pitch circle diameter) and blade tip position.

In this case, there is a requirement to modify the blade cross-sectional shapes at each of the blade root, the blade mean diameter and the blade tip positions of the blade effective portion 9 to correspond to the turbine driving steam inlet flow angles $\alpha_R$, $\alpha_P$ and $\alpha_T$ at each position. However, as a prerequisite for that, first there is a requirement to find turbine driving steam inlet flow speed vectors $BV_R$, $BV_P$ and $BV_T$ at each position.

Turbine driving steam inlet flow speed vectors $BV_R$, $BV_P$ and $BV_T$ at each position can be found from equivalent velocity diagrams composed of outlet flow speeds $SV_R$, $SV_P$ and $SV_T$ of the turbine driving steam flowing out from the blade root, the blade mean diameter and the blade tip positions of the turbine nozzle blades, and the circumferential speed vector (the turbine shaft circumferential speed component) determined by the radius and angular rotational speed at each position (the angular rotational speed of course being constant, independent of radial position).

For turbine driving steam inlet flow speed vectors $BV_R$, $BV_P$ and $BV_T$ at the various positions found from equivalent velocity diagrams, the inlet flow angles can vary. For example, the inlet flow angle $\alpha_T$ at the blade root typically is in the range of about 30° to about 50° while the inlet flow angle $\alpha_T$ at the blade tip typically is in the range of about 140° to about 170°, and their angular difference may be a maximum of about 140°. This large angular difference is due to the fact that the radial position of the blade tip (measured from the turbine shaft axis of rotation) is at least twice that of the blade root, and, proportionally, the circumferential speed component at the blade tip is at least twice that at the blade root.

If the turbine moving blade is not modified to compensate for this large variation in the inlet flow angle in the radial direction, aerodynamic loss will markedly increase. Therefore, prior art steam turbines were modified by varying the twist angle of the blade cross-section to conform it to the turbine driving steam inlet flow angles $\alpha_R$, $\alpha_P$ and $\alpha_T$ at the various positions on the blade effective portion 9; and, moreover, the blade cross-sectional shape close to the leading edge was modified in the direction of the inlet flow speed vector.

FIG. 14 is a drawing of a circumferential direction cross-section at any height of the turbine moving blade row, developed on a plane, and shows the configuration of the turbine moving blade steam passage. S is the throat, and indicates the width of the narrowest part in the inter-blade steam passage formed between the back of one blade and the belly of the next turbine moving blade. T is the pitch, that is the gap between turbine moving blades in the circumferential direction. The throat·pitch ratio (S/T) is an aerodynamic design parameter that does not depend on the size of the steam turbine, and corresponds to the outlet flow angle of the turbine moving blades. In other words, if the throat-pitch ratio (S/T) is increased, the turbine moving blade outlet flow angle, which is defined by taking the circumferential direction as zero, becomes larger and, when the blade outlet flow speed is taken as constant, the axial flow speed component becomes greater and the flow rate of this cross-section increases. Conversely, if the throat·pitch ratio (S/T) is decreased, the turbine moving blade outlet flow angle becomes smaller, and the flow rate of this cross-section decreases. The definition of the throat-pitch ratio (S/T) is the same for the turbine nozzle blades also.

In long-blade stages, such as the turbine final stage, the pressure difference between the inner wall side (blade root) and the outer wall side (blade tip), due to the tangential velocity component produced by the turbine nozzle blades, becomes greater. In the design of long blade stages, it is necessary to adopt a throat-pitch ratio (S/T) distribution that takes account of this pressure difference.

FIG. 15 is an example of the turbine moving blade throat-pitch ratio (S/T) distribution normally adopted in prior art designs. In the prior art "simplified three-dimensional design method," because it was difficult accurately to estimate the three-dimensional loss of each blade cross-section, designs were produced so that the flow rate distribution per unit annular area in the radial direction became approximately constant for both turbine nozzle blades and turbine moving blades. For the turbine moving blade, instead of the exit static pressure distribution being approximately constant, the flow speed increased on the outer wall side where the entry static pressure was high. Therefore, a design was adopted in which, in addition to reducing the axial flow speed by reducing the throat·pitch ratio (S/T) on the outer wall side, the axial flow speed was increased by increasing throat·pitch ratio (S/T) on the inner wall side where, conversely, the entry static pressure is low and the turbine moving blade outlet flow speed is low. Thus the radial direction flow distribution became approximately uniform.

With prior art turbine moving blades designed in this way, there are no problems when the blade height is low. However, with long blades exceeding 1 m in blade height, there is the problem that it is difficult sufficiently to ensure a pressure difference between the inlet and outlet of the blade root cross-section of the turbine moving blades that is commensurate with the relative pressure drop of the entry static pressure. This could lead to reduced performance. At the same time, by passing the same degree of flow rate both at the blade root cross-section and at other cross-sections, there is also the problem that the aerodynamic performance of the turbine stage as a whole is reduced.

FIG. 16 shows the throat·pitch ratio (S/T) distribution of a prior art turbine nozzle blade. With a turbine nozzle blade, in contrast to a turbine moving blade, as opposed to the entry total pressure being approximately uniform, the exit static pressure distribution has a distribution that increases from inside to outside. With the prior art "simplified three-dimensional design method," because it was difficult to forecast the loss distribution in the radial direction, it was taken as a premise that the flow distribution in the radial direction was uniform. For this reason, the throat·pitch ratio (S/T) distribution shown in FIG. 16, which increases continuously from blade root to blade tip, was adopted.

The problem with the distribution in FIG. 16 is that, due to the outlet flow angle at the blade root becoming smaller, the loss in this part increases. Also, there is the problem that, with the blade tip being close to the wall surface, loss is increased by secondary flow turbulence occurring in the corner between the wall surface and the turbine nozzle blade. Because the same degree of flow rate as in other blade regions flows through this region too, the aerodynamic performance of the turbine stage as a whole decreases.

FIG. 17 shows the radial direction distribution of aerodynamic loss in prior art turbine nozzle blades. At the blade root side, through reducing the outlet flow angle by making the throat·pitch ratio (S/T) smaller, a vicious circle has developed in which the more the outlet flow speed increases, the more the loss increases.

A desirable objective, therefore, has been of an overall three-dimensional design method that takes account of the effect by which the flow distribution in the circumferential direction is varied, and the effect of blade deformation due to centrifugal force. However, the prior art solutions to date have not eliminated all problems. One such solution now will be described with reference to FIGS. 14 and 15. A row of turbine moving blades is designed in a form in which the leading edge is twisted in the clockwise direction from the blade root to the blade tip. Therefore, when a tensile load due to centrifugal force acts on the blade effective portion 9, twist-return (untwisting ) occurs in the direction of arrow AR shown in FIG. 14. Accordingly, as shown in FIG. 15, the throat·pitch ratio (S/T) of the turbine moving blade 4, although set in the distribution shown by the solid line from blade root to blade tip when at rest, theoretically changes to the distribution shown by the broken line during operation. However, the measures taken to control vibration of the turbine moving blades (i.e., the intermediate connectors 11 in the intermediate part of the blade effective portion 9 and tip connectors 10 at the blade tips) restrict blade untwisting at these connecting points, and the throat·pitch ratio (S/T) distribution in the 70% to 95% height that is normalized between connectors 10 and 11, as shown in FIG. 15, swells outward and becomes a broad passage.

Further problems can result from this situation. In the case of the long blade turbine moving blades 4, where the diameter of the blade root is 1.4 m or more and the blade effective portion 9 exceeds 1 m, the equivalent speed of the motive steam leaving the turbine moving blade (the speed defined by coordinates set by the turbine moving blades) exceeds the speed of sound at least in the region from the mean diameter of the blade effective portion 9 (PCD: pitch circle diameter) to the blade tip, and becomes a supersonic speed flow. Given the range of turbine driving steam inlet flow angles, as shown in FIG. 13, along the blade effective portion 9, if the above-mentioned swollen portion occurs in the throat·pitch ratio (S/T) distribution in the 75% to 95% normalized blade height region, the supersonic flow of turbine driving steam will be expanded excessively, and a strong shock wave will be generated on the turbine moving blade.

Prior art steam turbines thus suffer from many drawbacks. They adopt throat·pitch ratio (S/T) distributions that yield almost uniform flow distributions in the radial direction, resulting in high frictional losses close to the wall surface at the blade roots of the turbine moving blades and close to the outer wall surface of the turbine nozzle blade tips. They also can suffer from shock waves caused by the interaction of supersonic steam flow with swollen blade portions between the restricted parts of the blade effective portion 9 due to blade untwisting. These drawbacks prevent the turbine from performing in accordance with design criteria.

SUMMARY OF THE INVENTION

It is an object of this invention to provide a steam turbine designed to improve turbine blade row performance.

It is a further object of this invention to provide a turbine moving blade which will make turbine driving steam flow in a stable state, thereby improving the performance of the turbine.

It is still a further object of this invention to provide a turbine nozzle blade which will make the turbine driving steam flow in a stable state, thereby improving performance of the turbine.

To achieve the objects, a three-dimensional blade design method devised and adopted for a turbine moving blade of the present invention is one that treats the turbine driving steam as a three-dimensional flow, and can control that three-dimensional flow. Therefore, accuracy is greater than with the prior art simplified three-dimensional blade design method.

Stated otherwise, in the turbine blade row, the throat·pitch ratio (S/T) of the turbine moving blades is off-set prior to operation. When blade untwist occurs during operation, excessive expanded flow in the supersonic speed region is prevented by producing an appropriate throat·pitch ratio (S/T) distribution corresponding to the turbine driving steam entry angle by maintaining proper values.

At the same time, a flow distribution is given in the radial direction so that, with both turbine moving blades and turbine nozzle blades, the turbine driving steam flow is reduced in regions close to the wall surface where losses otherwise would be large while, on the other hand, the turbine driving steam flow is increased in regions distant from the wall surface where losses are small.

BRIEF DESCRIPTION OF THE DRAWINGS

A more complete appreciation of the invention and many of the attendant advantage thereof will be readily obtained and better understood by reference to the following detailed description when considered in connection with the accompanying drawings.

DETAILED DESCRIPTION OF A PREFERRED EMBODIMENT

Figure 1:
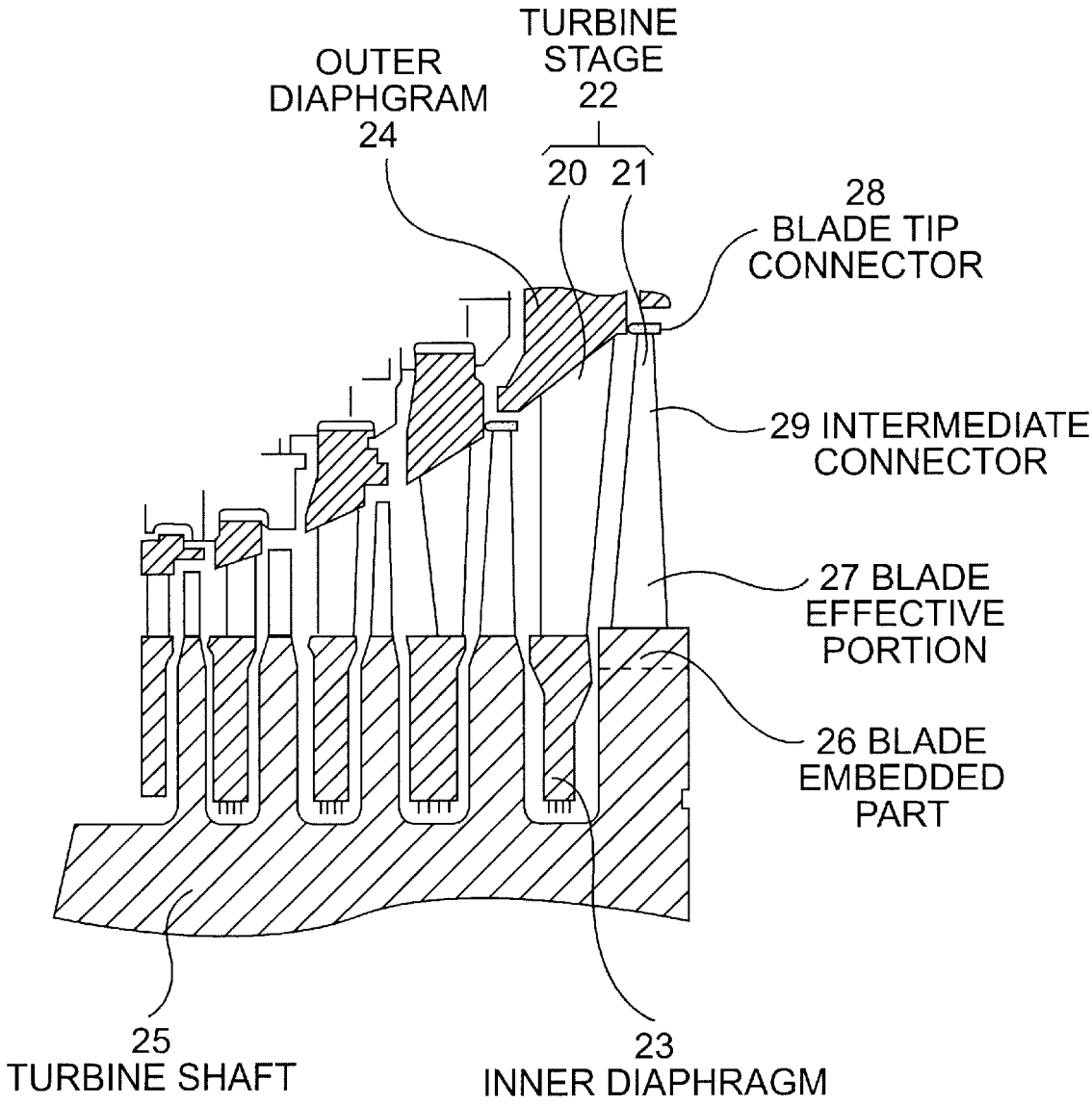
FIG. 1 is a schematic partial sectional view showing an embodiment of a steam turbine according to the present invention.

A preferred embodiment of turbine moving blades and turbine nozzle blades assembled into a turbine relating to the present invention will be described below with reference to the drawings and the reference numerals assigned in the drawings.

In the steam turbine relating to this embodiment, as shown in FIG. 1, a turbine stage 22 is composed of an assembly of turbine nozzle blades 20, which are supported at their ends by an inner diaphragm 23 and an outer diaphragm 24, and an assembly of turbine moving blades 21, which are embedded in the turbine shaft 25. A plurality of such turbine stages 22 are arranged along the turbine shaft 25.

The blades are made of an alloy of about 88% to about 92% titanium, about 4% to about 8% aluminium and about 2% to about 6% vanadium by weight percent. A rotation speed of 300 rpm is used in 50 Hz areas and a rotation speed of 3600 rpm is used in 60 Hz areas.

Each turbine moving blade 21 has a blade embedded part 26 and a blade effective portion 27. Also, each turbine moving blade 21 is provided with a blade tip connector 28 at the blade tip, and an intermediate connector 29 at the blade intermediate part. The diameter of the blade root of the blade effective portion 27 is 1.4 m or more, and the blade height is 1.0 m or more.

Figure 11:
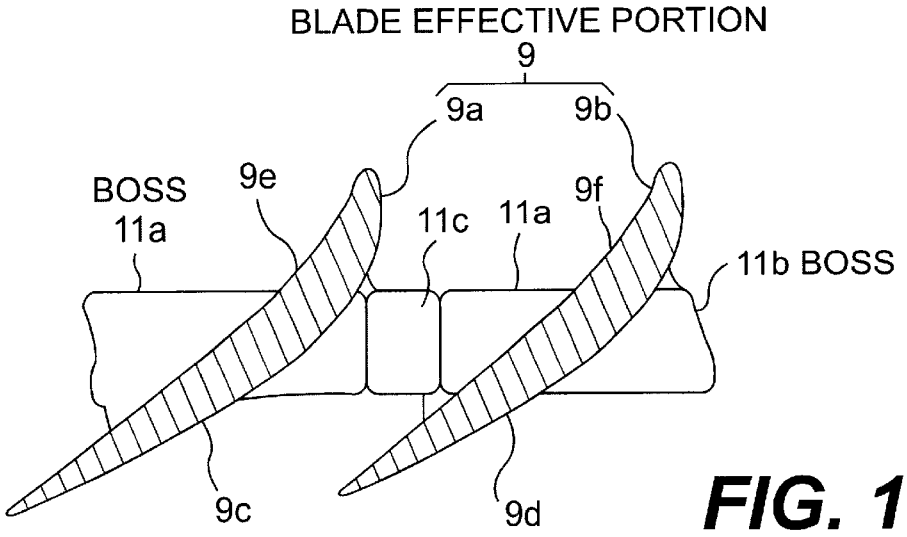
FIG. 11 PRIOR ART
FIG. 11 is a partial sectional view taken along line 11—11 in FIG. 10, showing an intermediate connector.
Figure 12:
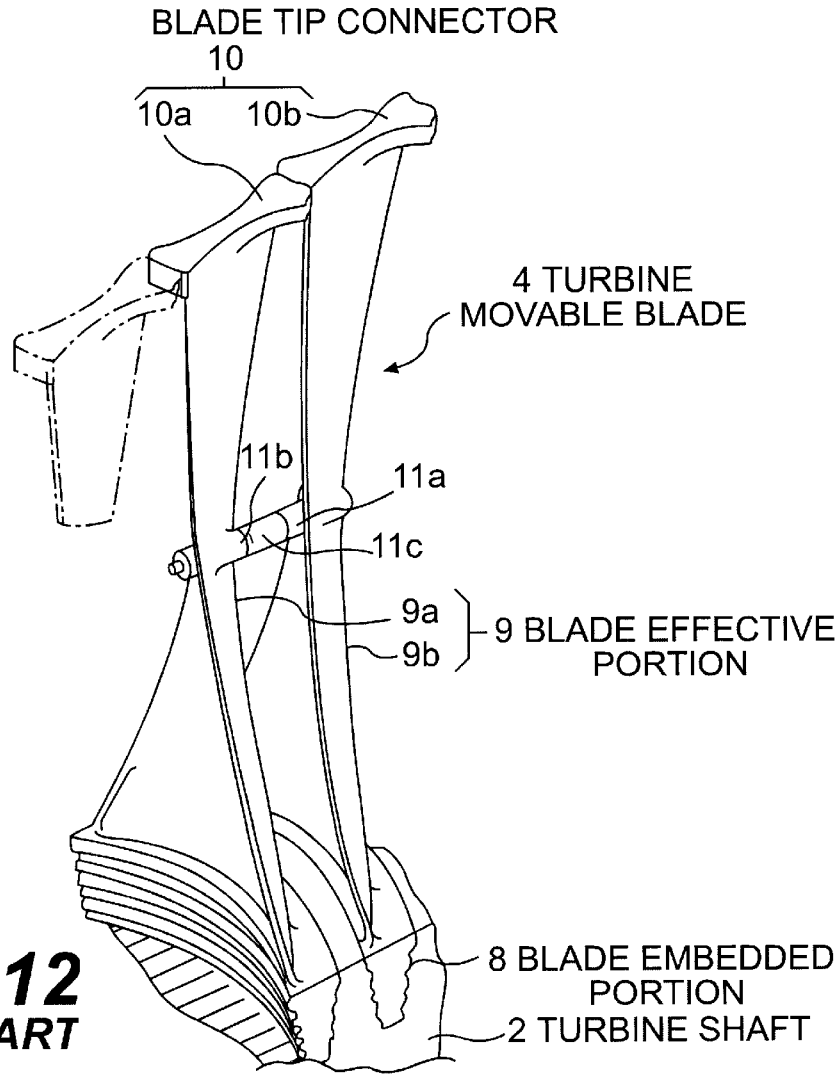
FIG. 12 PRIOR ART
FIG. 12 is a schematic oblique view of blade tip connectors viewed from the direction of arrows 12—12 in FIG. 10.
Figure 13:
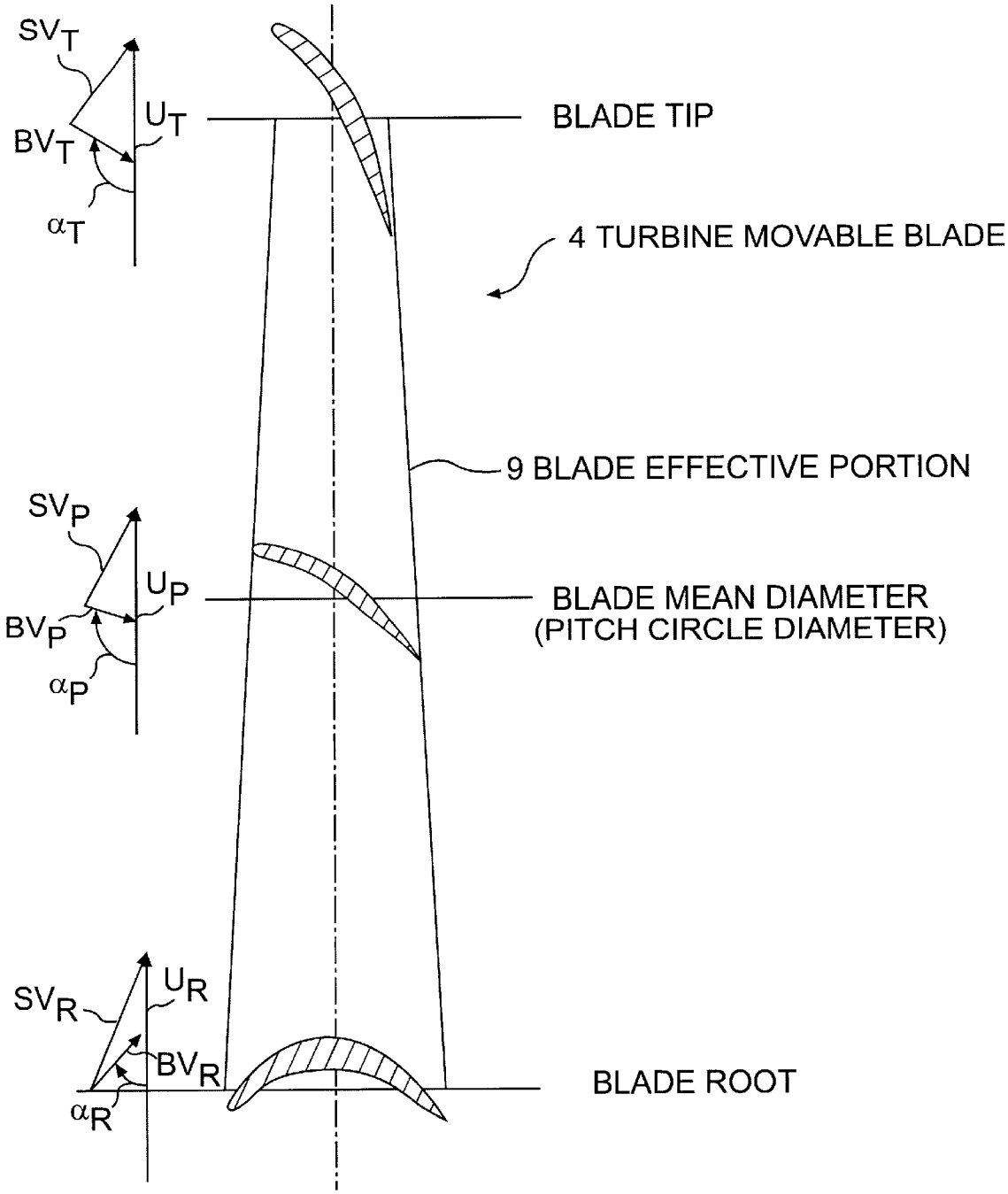
FIG. 13 PRIOR ART
FIG. 13 is a schematic drawing showing equivalent velocity graphs for inflowing turbine driving steam for each of blade root, blade mean diameter and a blade tip positions of a turbine moving blade in a final stage.

The intermediate connector 29 is installed in a position in the about 50% to about 70% range of normalized blade height and is designed to reduce vibration of the turbine moving blades 21 during operation and, simultaneously, to suppress any untwisting of the turbine moving blade 21 to a low level. The blade tip connector 28 and the intermediate connector 29 are respectively of the same configurations as shown in FIG. 11 and FIG. 12, and described above in reference to those figures.

Figure 2:
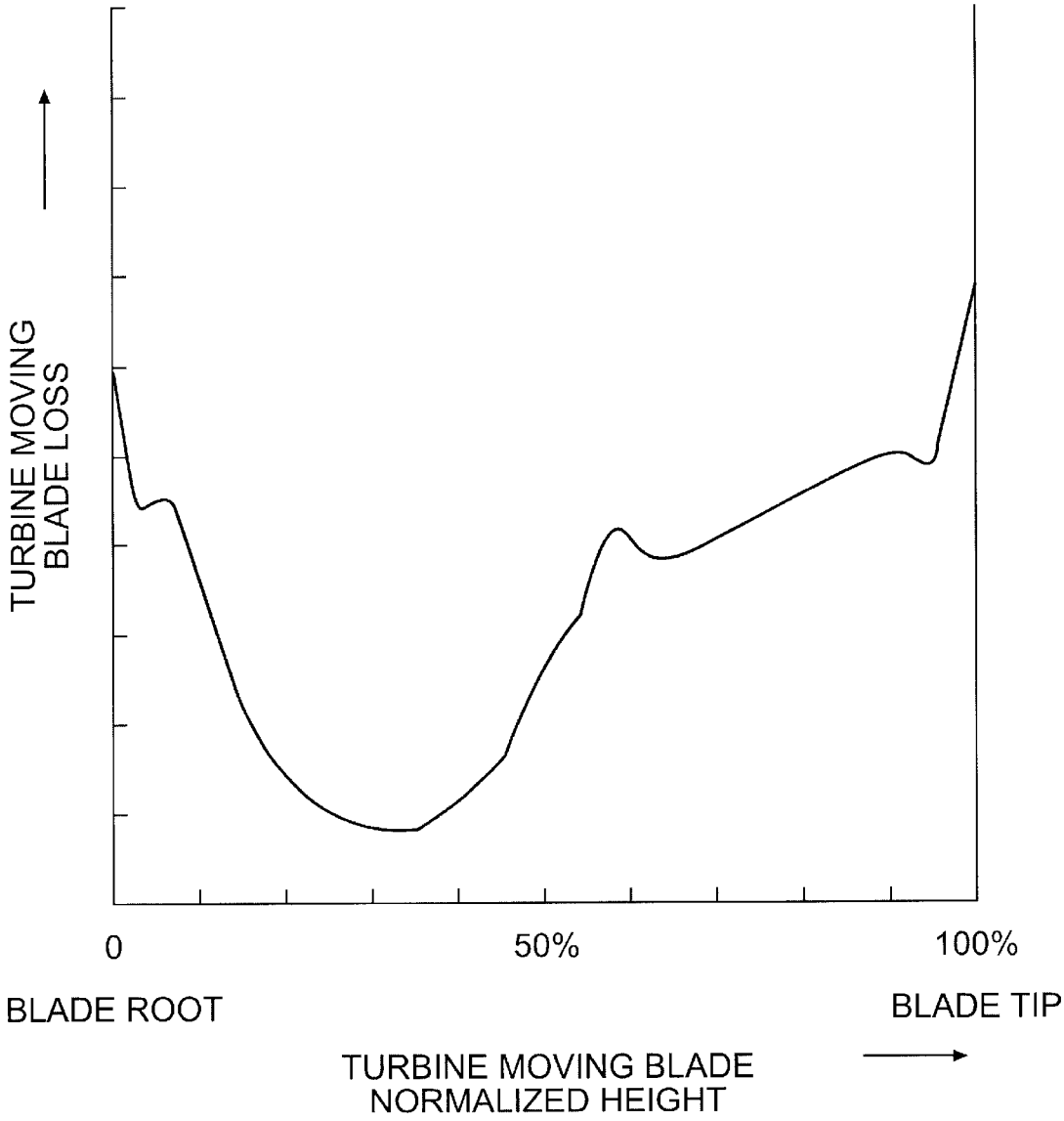
FIG. 2 is a loss distribution graph for a turbine moving blade assembly according to the present invention.

The turbine moving blade 21 has a blade row performance distribution shown in FIG. 2. This blade row performance distribution shows aerodynamic loss (turbine moving blade loss) on the vertical axis and normalized blade height on the horizontal axis, respectively, and shows that aerodynamic loss becomes small in the normalized blade height range of about 15 to about 45%. This blade row performance distribution was obtained by numeric analysis of the turbine driving steam flow, and agrees well with experimental data for model turbines and, as such, is effective data when carrying out three-dimensional design of a blade row.

Figure 3:
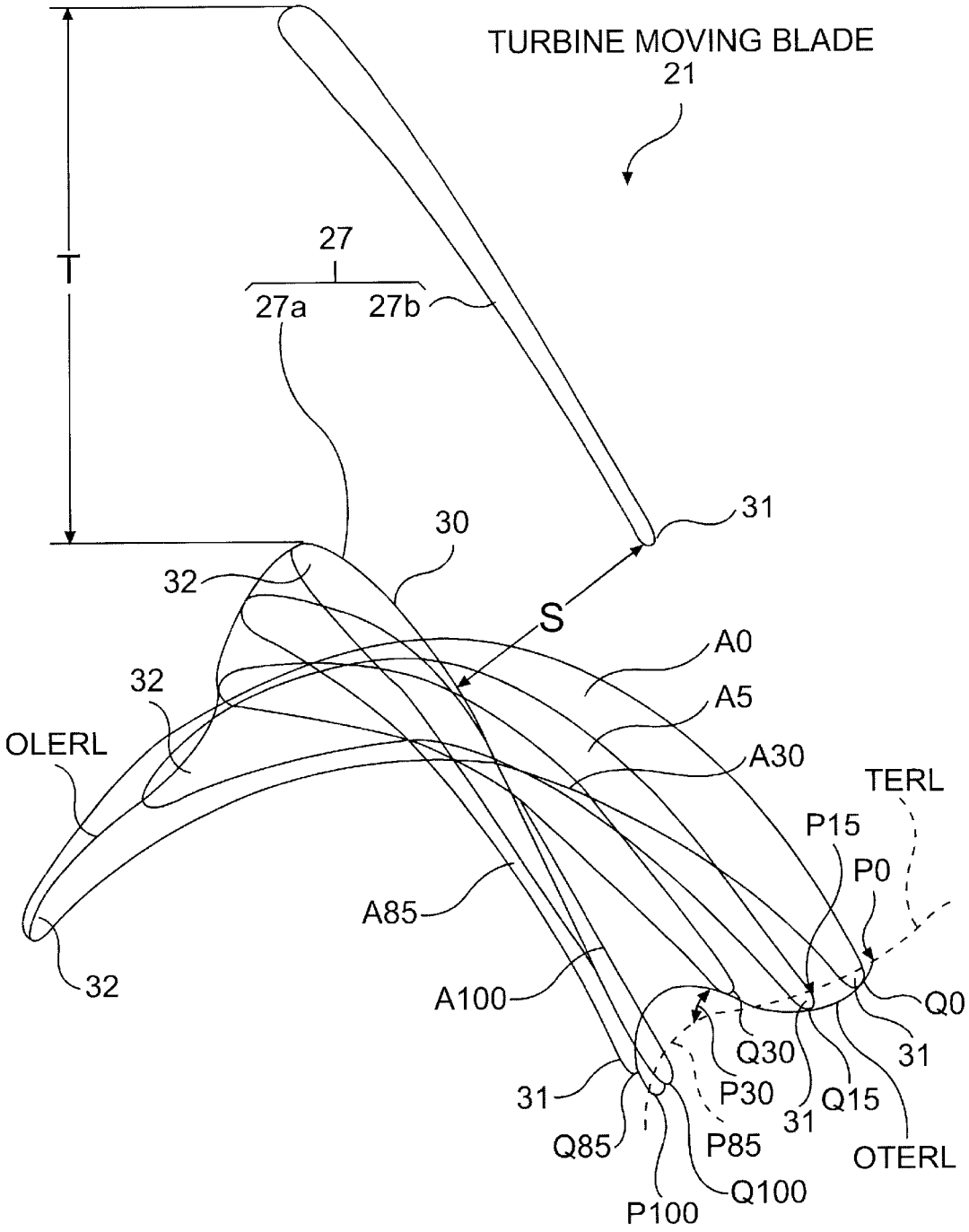
FIG. 3 is a superimposed plan view showing individual blade sectional views cut at arbitrary positions along the height of a turbine moving blade from blade root to blade tip according to the present invention.

Referring to FIG. 3, with the turbine moving blades 21 subject to such design requirements and provided with such a blade row performance distribution, the three-dimensional flow pattern of the turbine blade row can be optimized by the appropriate setting of throat·pitch ratio (S/T), where the pitch between one blade effective portion 27*a* and the adjacent blade effective portion 27*b* is taken as T, and the width of the flow throat (the narrowest passage) formed by the back 30 of the one blade effective portion 27*a* and the belly of the adjacent blade effective portion 27*b* is taken as S.

In FIG. 3, when blade cross-sections are taken at arbitrary positions along the blade height from the blade root to the blade tip (for example, when the blade cross-section at the blade root (blade height 0%) is taken as $A_0$, the blade cross-section at blade height about 15% as $A_{15}$, the blade cross-section at blade height about 30% as $A_{30}$, the blade cross-section at blade height about 85% as $A_{85}$, and the blade cross-section at blade tip (blade height 100%) as $A_{100}$), then, if a greater twist angle is given to each cross-section $A_0, A_{15}, \ldots$ than in the prior art, the prior art trailing edge ridge line TERL (shown by the broken line) that joins each trailing edge 31, 31, . . . shifts to off-set trailing edge ridge line OTERL (shown by the solid line).

In practice, the twist angle is given in the clockwise direction so that cross-section $A_0$ shifts from point $P_0$ to point $Q_0$, cross-section $A_{15}$ shifts from point $P_{15}$ to point $Q_{15}$ and cross-section Ass shifts from point $P_{85}$ to point $Q_{85}$, and also the twist angle is given in the anti-clockwise direction so that cross-section $A_{30}$ shifts from point $P_{30}$ to point $Q_{30}$ and cross-section $A_{100}$ shifts from point $P_{100}$ to point $Q_{100}$. Offset leading edge ridge line OLERL is formed by the solid line that joins a leading edges 32, 32, . . . of each cross-section $A_0$, $A_{15}$, . . . The twist angles given to each cross-section $A_0$, $A_{30}$, . . . are in the clockwise or anti-clockwise direction when viewed with the leading edges on the left and, at the same time, with the backs facing upwardly.

Figure 4:
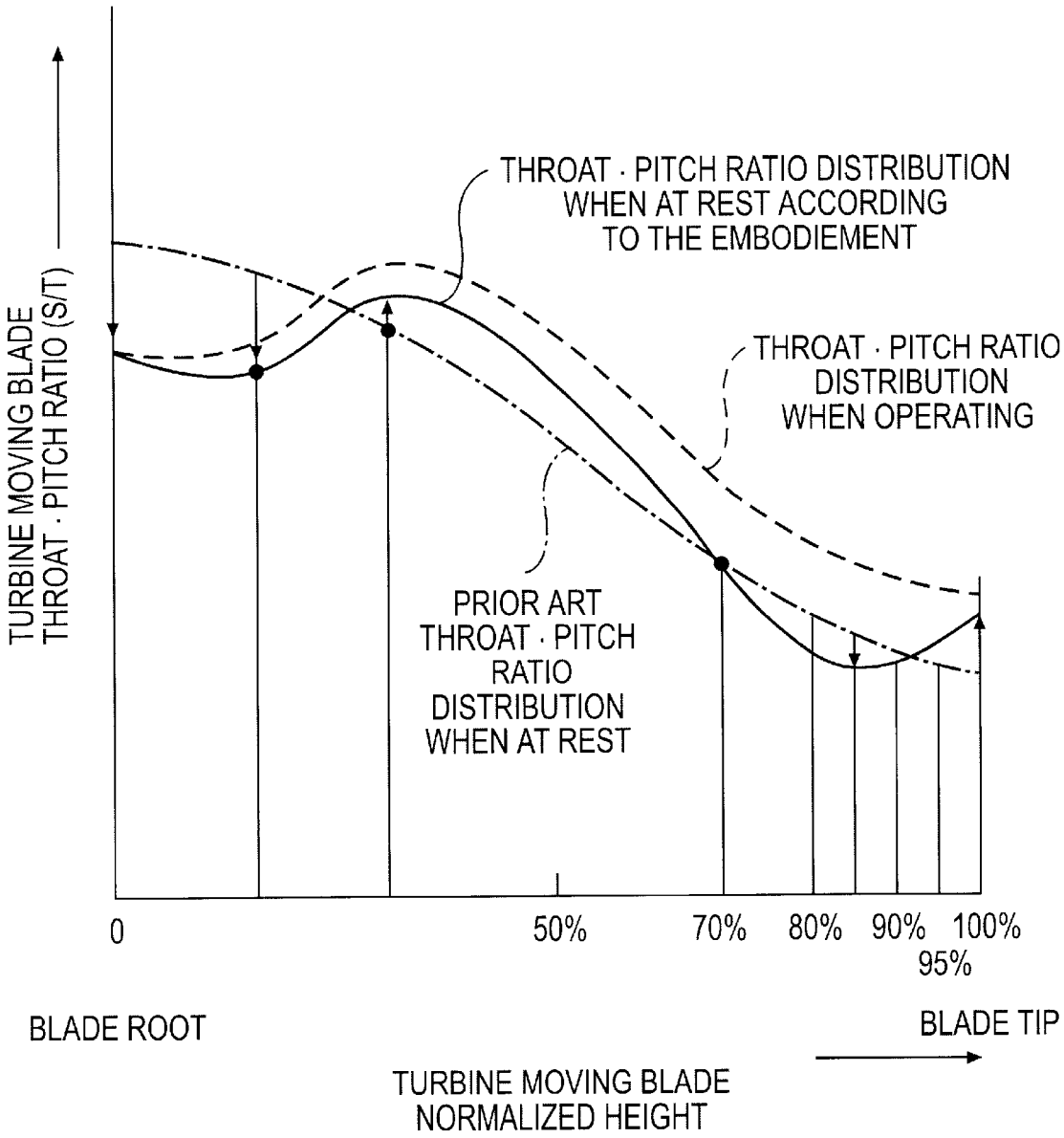
FIG. 4 is a static throat·pitch ratio (S/T) distribution graph for a turbine moving blade according to the present invention compared with a prior art static throat·pitch ratio (S/T) distribution and a throat·pitch ratio (S/T) distribution when operating.

If off-setting is performed by setting the twist angles as mentioned above, throat·pitch ratio (S/T), which is determined by the distance between turbine moving blades, will have the distribution shown by the solid line in FIG. 4 when at rest, and the distribution shown by the broken line during operation.

If a larger blade twist angle than in the prior art is given to each cross-section $A_0, A_{15}, \ldots$, and the throat·pitch ratio (S/T) for each cross-section $A_0, A_{15}, \ldots$ is determined based on the blade twist angle, that throat·pitch ratio (S/T) distribution, as shown by the solid line in FIG. 4, forms a roughly S-shaped curve having a maximum and a minimum. At the same time, the solid line is markedly shifted from the prior art throat·pitch ratio (S/T) position shown by the single-dot chain line, and is maintained, so-to-speak, off-set. Here, "maximum" and "minimum" are defined in the local sense, i.e., with reference to neighboring values, as follows:.

1) If f(x)" is negative when f(x)'=0, f(x) is a maximum;

2) If f(x)" is positive when f(x)'=0, f(x) is a minimum.

In other words, a "maximum" is one which is surrounded by lesser values; a "minimum" is one which is surrounded by greater values.

In this way, with this embodiment, throat- pitch ratio (S/T) is determined beforehand by giving a greater twist angle than in the prior art to each cross-section $A_0, A_{15}, \ldots$, and the determined (S/T) is off-set to the position shown by the solid line. This differential twist angle (as compare to the prior art) is defined herein as the "differential blade twist angle".

Along with the untwisting that occurs during operation, the (S/T) distribution moves from the off-set position and conforms to the throat·pitch ratio (S/T) position shown by the broken line. Therefore, more turbine driving steam can be made to flow in regions where losses are small and less in regions where losses are large, resulting in improved turbine blade row performance.

The throat·pitch ratio (S/T) distribution graph for the turbine moving blade 21 shown in FIG. 4 is one in which the differential blade twist angle was set over all blade cross-sections $A_0, A_{15}, \ldots$ for the entire blade from blade root to blade tip. However, whether to impart the differential blade twist angle over the entire length of the blade, or over a smaller portion of the blade, depends on whether the turbine driving steam flow is subsonic, transonic, or supersonic.

Figure 5:
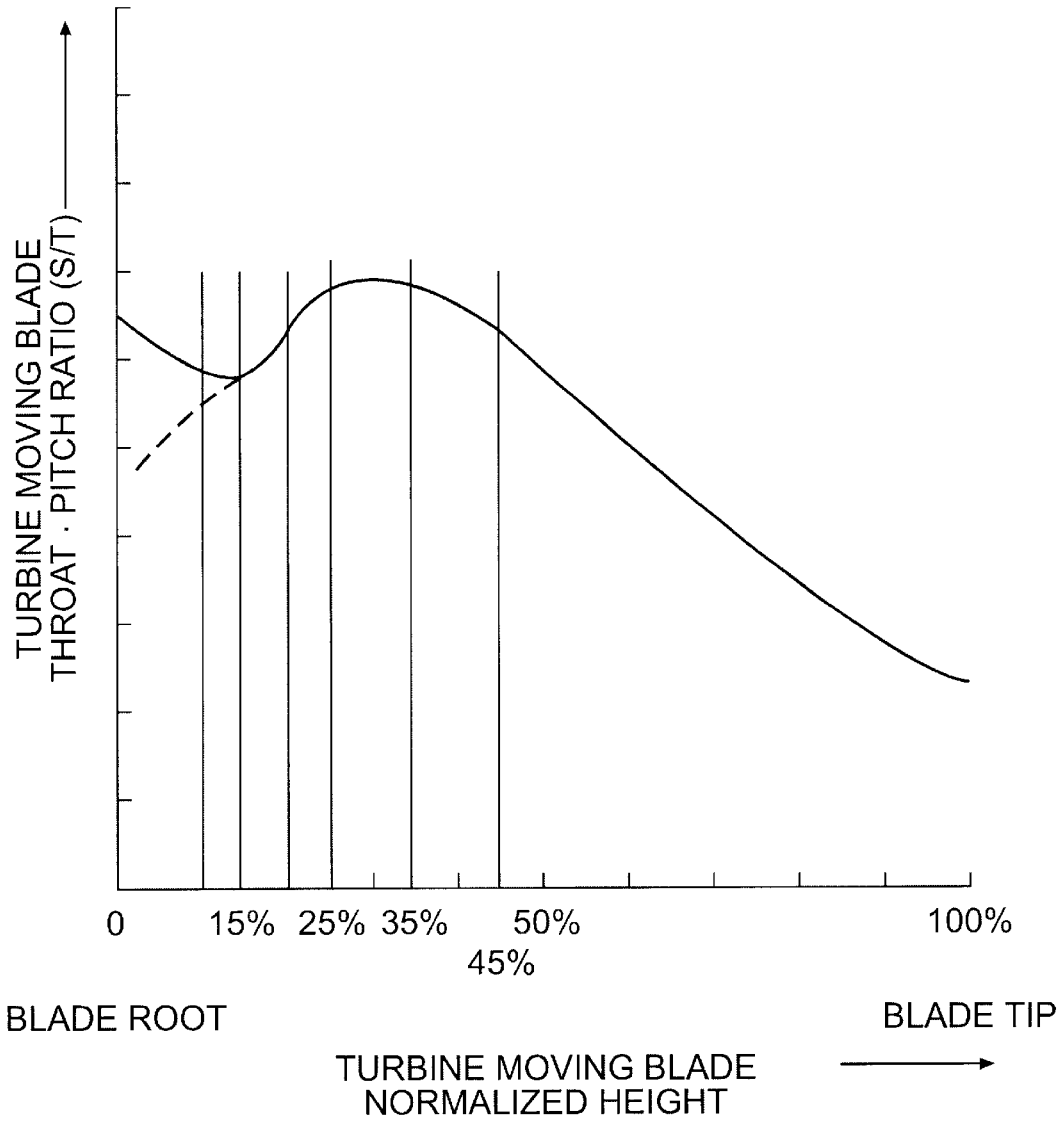
FIG. 5 is a throat·pitch ratio (S/T) distribution graph showing a static throat·pitch ratio (S/T) from a blade height of about 0% to a blade height of about 50% for a turbine moving blade according to the present invention.

When the turbine driving steam flow is subsonic or transonic, for the turbine moving blade 21, as shown in FIG. 5, throat·pitch ratio (S/T) is determined by giving a differential blade twist angle to each blade cross-section in the blade height range from about 10% to about 45%, taking the blade root (blade height 0%) as the reference, and the predetermined throat·pitch ratio (S/T) distribution is formed as a curve having at least one minimal value or maximal value, or forms a so-called S-shaped curve having a minimal value and a maximal value. In practice, it is preferable that the minimal value of throat·pitch ratio (S/T) should be formed in at a blade height position in the range from about 10% to about 20%, and the maximal value of throat·pitch ratio (S/T) should be formed at a blade height position in the range from about 15% to about 45%.

Predetermining throat·pitch ratio (S/T) by giving a differential blade twist angle to each cross-section in the blade height range from about 10% to about 45%, and setting the throat·pitch ratio (S/T) distribution curve to have at least one minimal value or maximal value or an S-shaped curve having a minimal value and a maximal value as described above, compensates for blade untwisting that occurs during operation and, at the same time, passes more turbine driving steam in the region where turbine moving blade loss is small, as shown in FIG. 2, thus improving turbine row performance. However, special attention must be given to giving a differential blade twist angle at blade height positions of about 10% or less.

Specifically, if the throat·pitch ratio (S/T) is made smaller close to the wall surface (the turbine shaft) at the blade root, the outlet flow angle will become smaller and secondary flow loss will increase due to turbulence in the vicinity of the blade root in the corner between the blade and the embedded portion, where a root fillet is added in order to relieve stress concentration. In order to prevent the actual throat·pitch ratio (S/T) that includes the root fillet from becoming too small, it is necessary to adjust the blade twist angle of the root fillet to make the throat·pitch ratio (S/T) larger.

Figure 6:
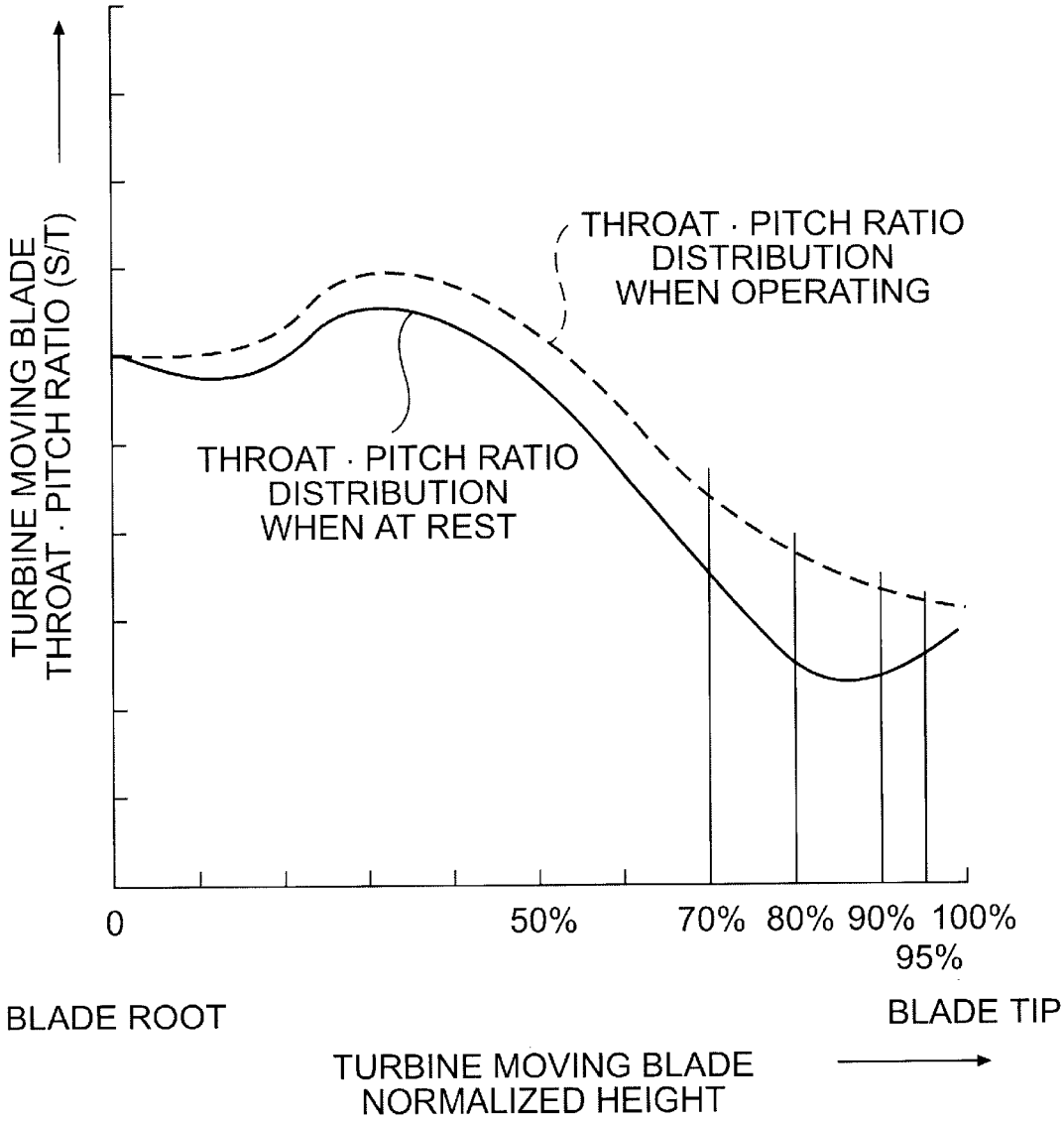
FIG. 6 is a throat·pitch ratio (S/T) distribution graph comparing throat·pitch ratio (S/T) from a blade height of about 0% to a blade height of about 100% for a turbine moving blade according to the present invention when at rest and when operating.
Figure 15:
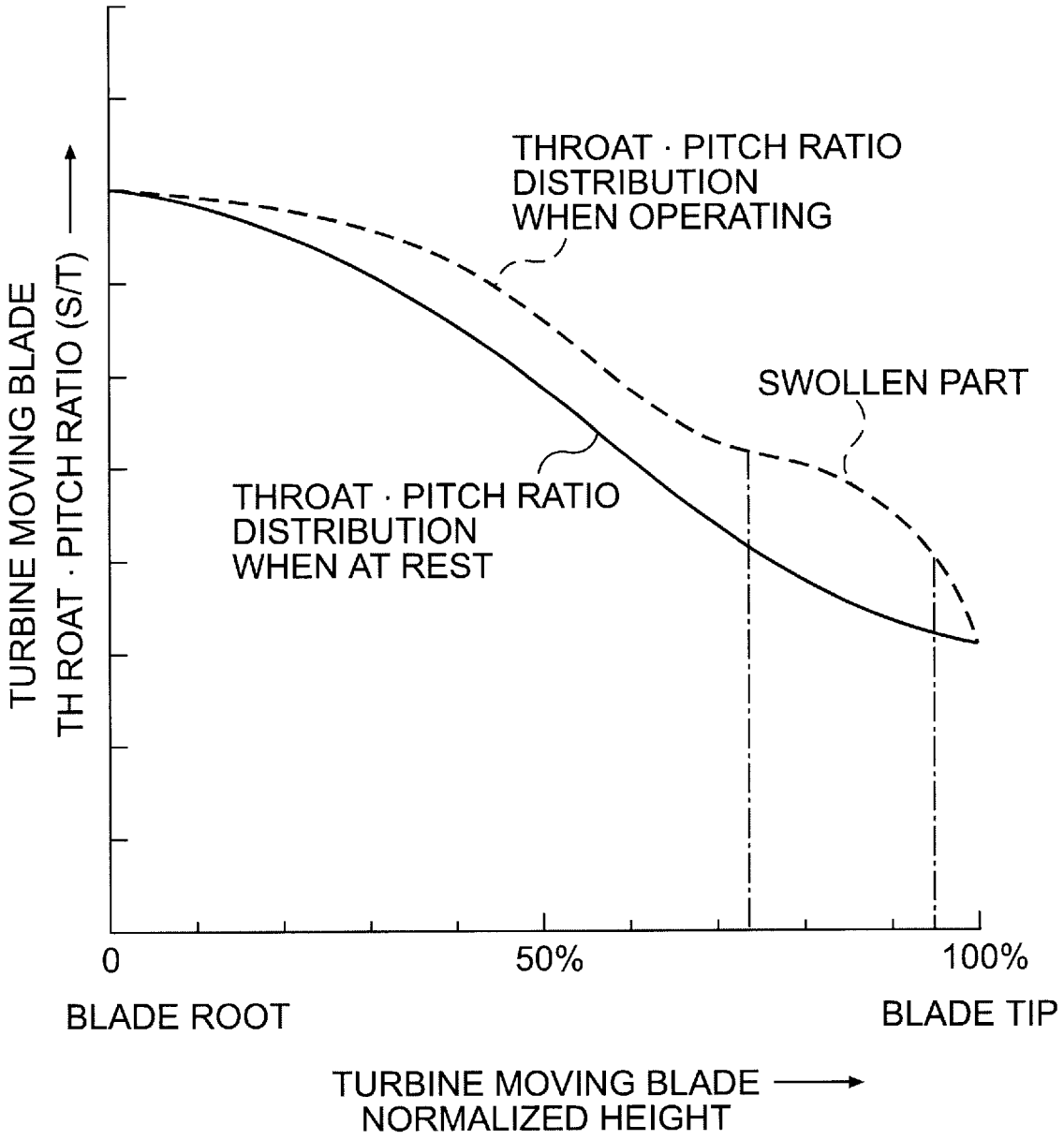
FIG. 15 PRIOR ART
FIG. 15 is a throat·pitch ratio (S/T) distribution graph comparing throat·pitch ratio (S/T) when at rest and throat pitch ratio (S/T) during operation for a turbine moving blade in the final turbine stage.
Figure 16:
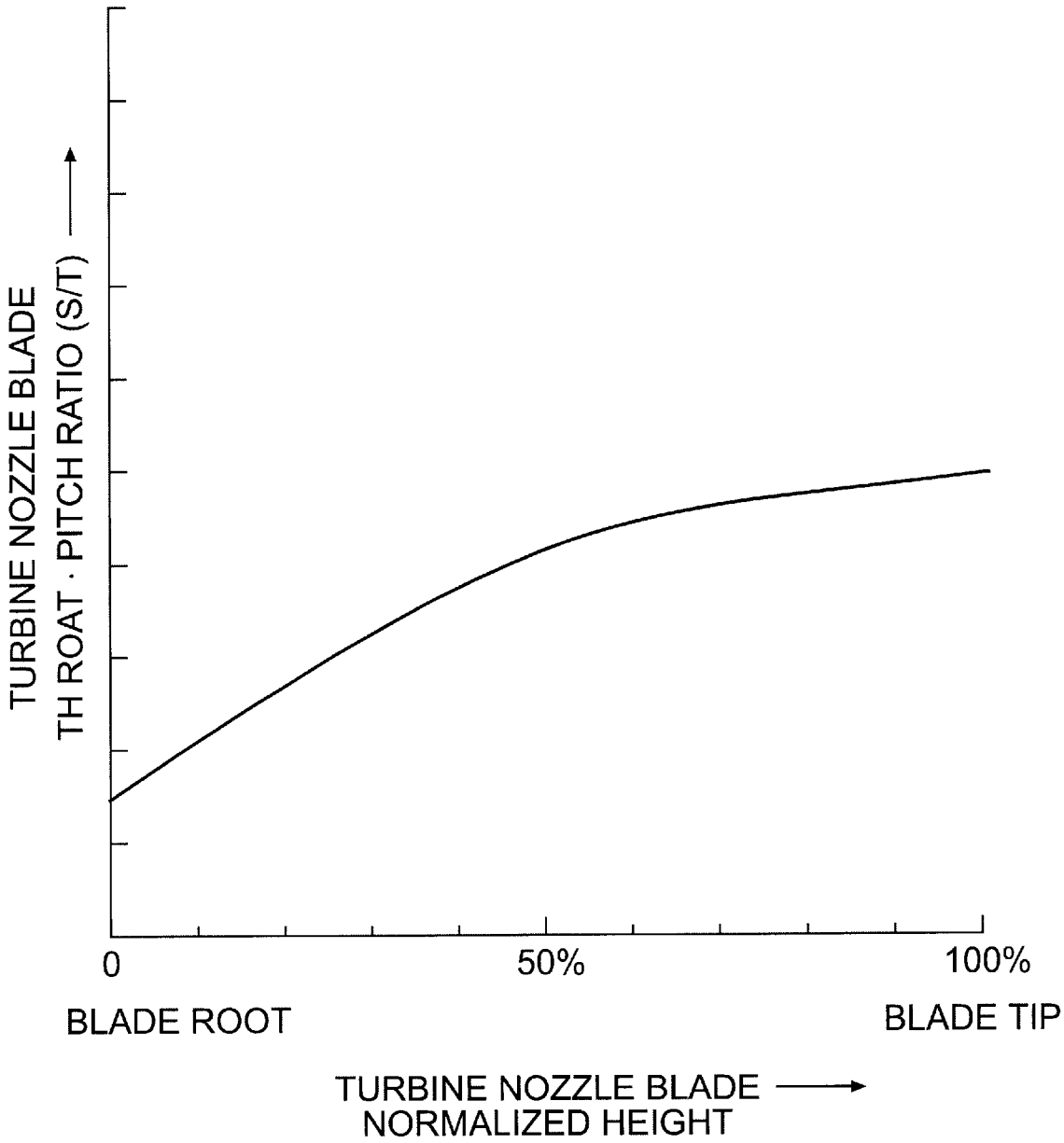
FIG. 16 PRIOR ART
FIG. 16 is a throat·pitch ratio (S/T) distribution graph showing throat·pitch ratio (S/T) for a turbine nozzle blade in a final turbine stage.
Figure 17:
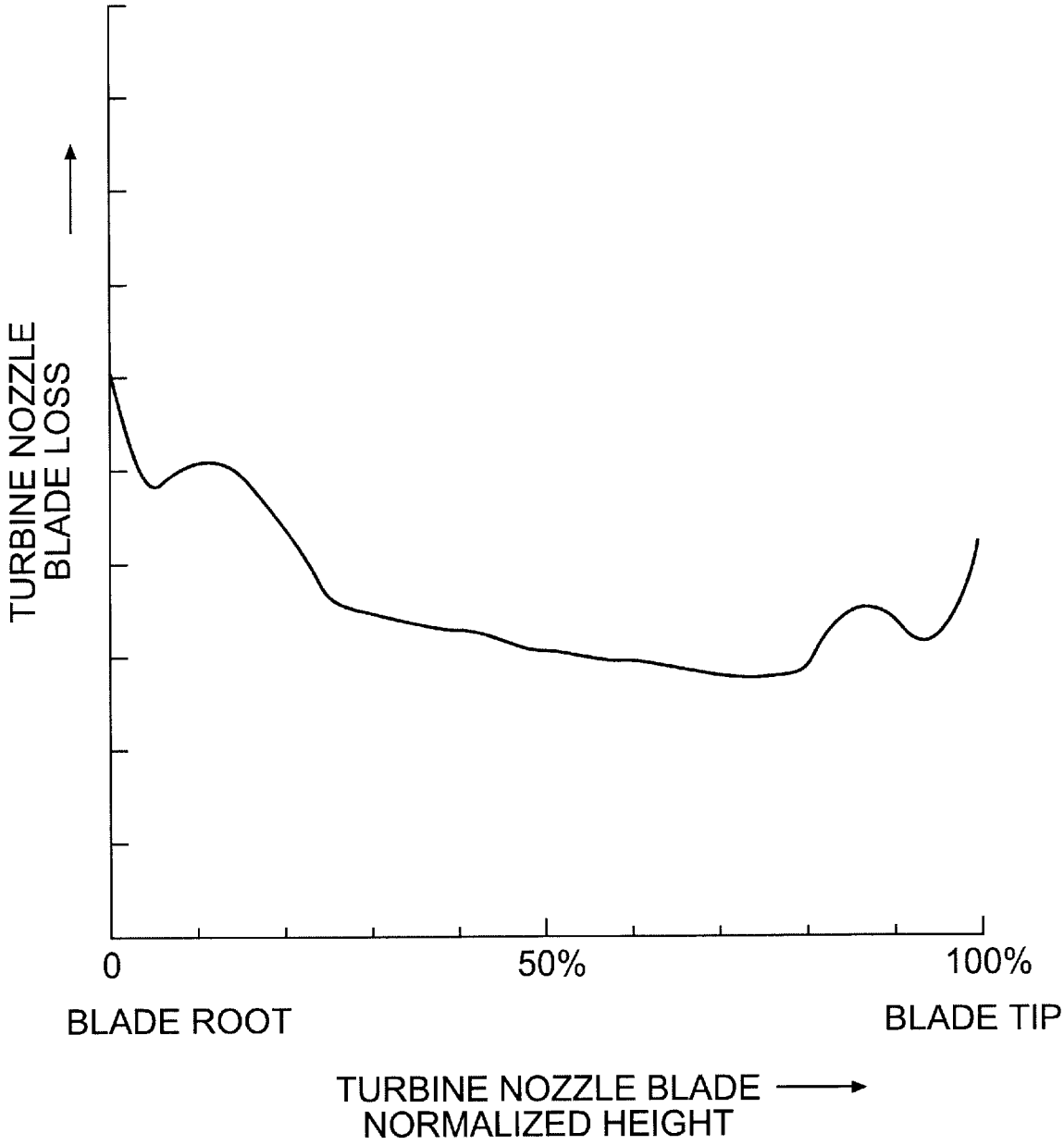
FIG. 17 PRIOR ART
FIG. 17 is a loss distribution graph for a turbine nozzle blade in a final turbine stage.

When the turbine driving steam flows at supersonic speed, for the turbine moving blade 21, as shown in FIG. 6, taking the blade root as the reference in the same way as mentioned above, the throat·pitch ratios (S/T) are predetermined by giving a differential blade twist angle to each blade cross-section from a blade height of about 10% to a blade height of about 95%. The distribution of the predetermined throat·pitch ratios (S/T) thus forms an S-shaped curve which has a minimal value and a maximal value in the blade height range from about 10% to about 95% and, at the same time, is off-set in a curve having a minimal value in a blade height range from about 70% to about 95%, and preferably in the range from about 80% to about 90%. This arrangement suppresses the swollen portion (shown in FIG. 15) which occurs when the blades untwist during operation, and ensures that turbine driving steam flow remains in a stable state, thus suppressing the generation of shock waves.

Figure 14:
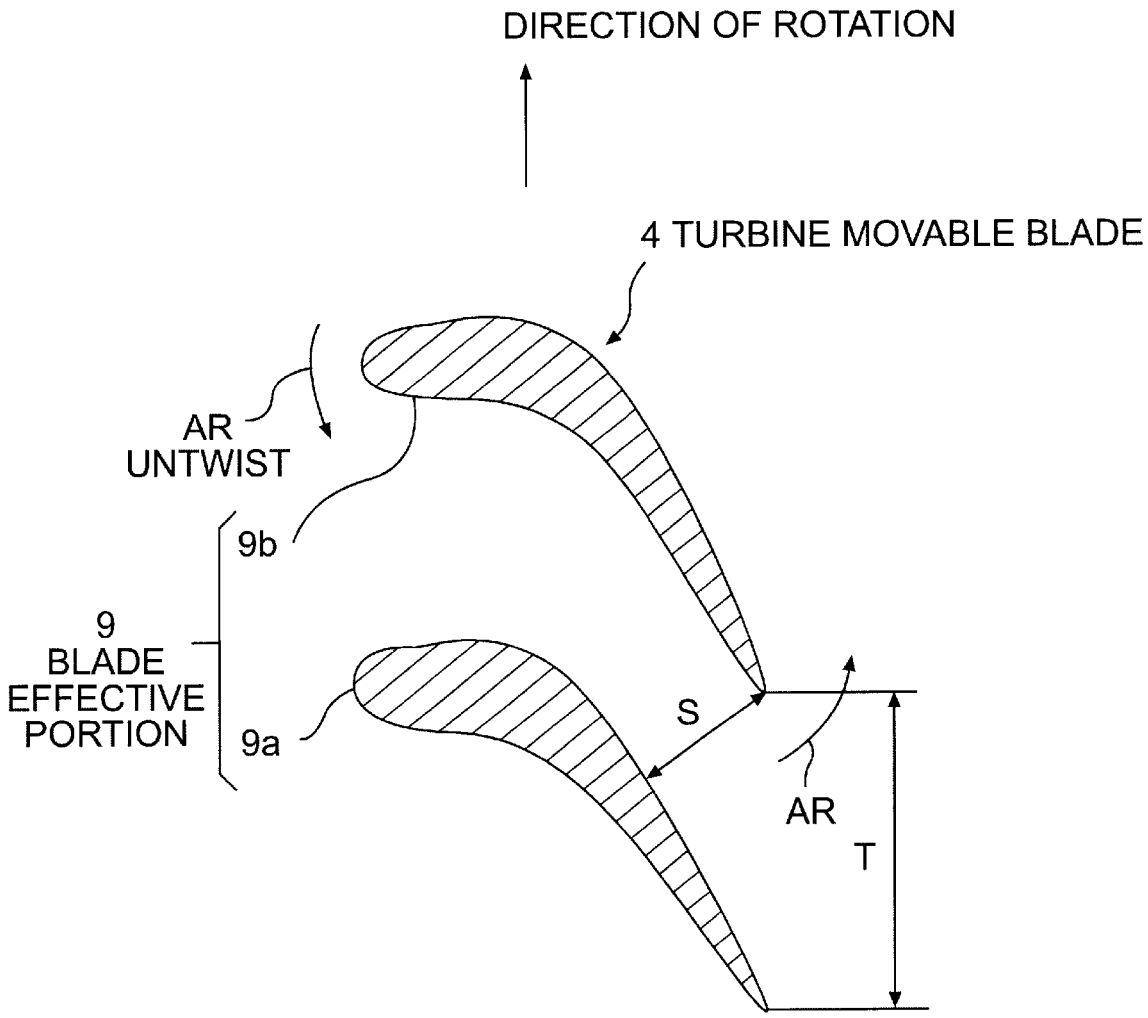
FIG. 14 PRIOR ART
FIG. 14 is a partial development sectional view showing a blade row of turbine moving blades in a final turbine stage.

Further improvement in turbine efficiency in long-blade turbines can be realized by giving differential blade twist angles to the blade cross-sections of the turbine nozzle blades 20, so that the steam outlet flows from the turbine nozzle blades will more effectively cooperate with the turbine moving blades in their dynamic configuration. The throat·pitch ratio (S/T) for the turbine nozzle blades is defined in the same way as (S/T) for the turbine moving blades 4, as shown in FIG. 14.

Figure 7:
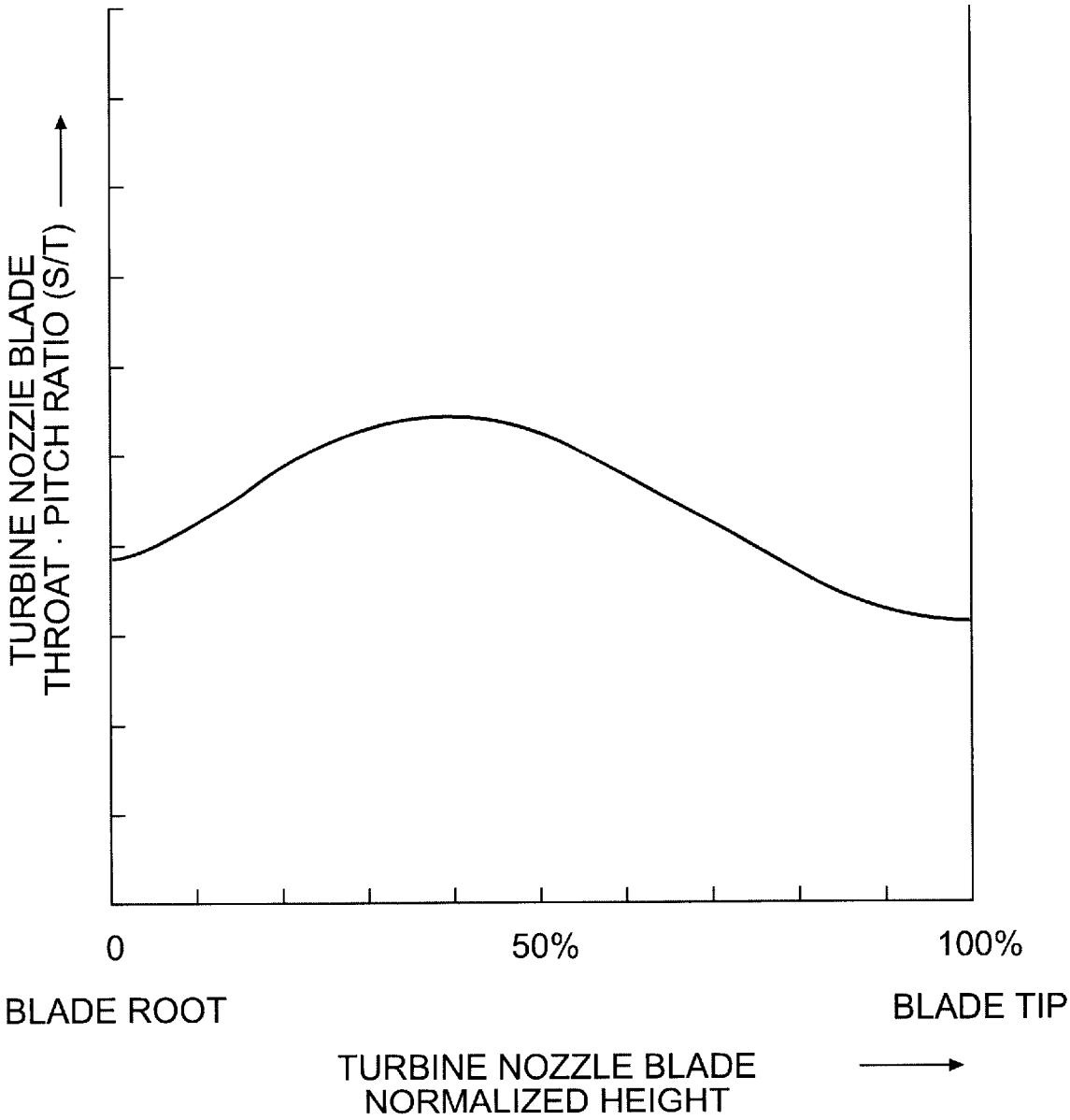
FIG. 7 is a throat·pitch ratio (S/T) distribution graph showing throat·pitch ratio (S/T) from a blade height of about 0% to a blade height of about 100% for a turbine nozzle blade according to the present invention.

When considering the distribution of this throat·pitch ratio (S/T) in the blade height direction from the blade root (blade height 0%) to the blade tip (blade height 100%), as shown in FIG. 7, it appears swollen outward in the blade height range from about 20% to about 80%, taking the blade root as the reference, as if a maximal value were formed. Here, for turbine nozzle blade 20, the blade root adjacent the inner diaphragm 23 shown in FIG. 1, and the blade tip is adjacent the outer diaphragm 24.

This distribution of the throat·pitch ratio (S/T) results from giving differential blade twist angles to the cross-sections as if a maximal value were formed in the blade height range of about 20% to about 80%; setting throat·pitch ratio (S/T) at the blade root (blade height 0%) in the range about 0.1 to about 0.5; and setting throat·pitch ratio (S/T) at the blade tip (blade height 100%) in the range about 0.14 to about 0.5, respectively. Thus, the total loss (turbine nozzle blade loss plus turbine moving blade loss) is reduced.

Figure 8:
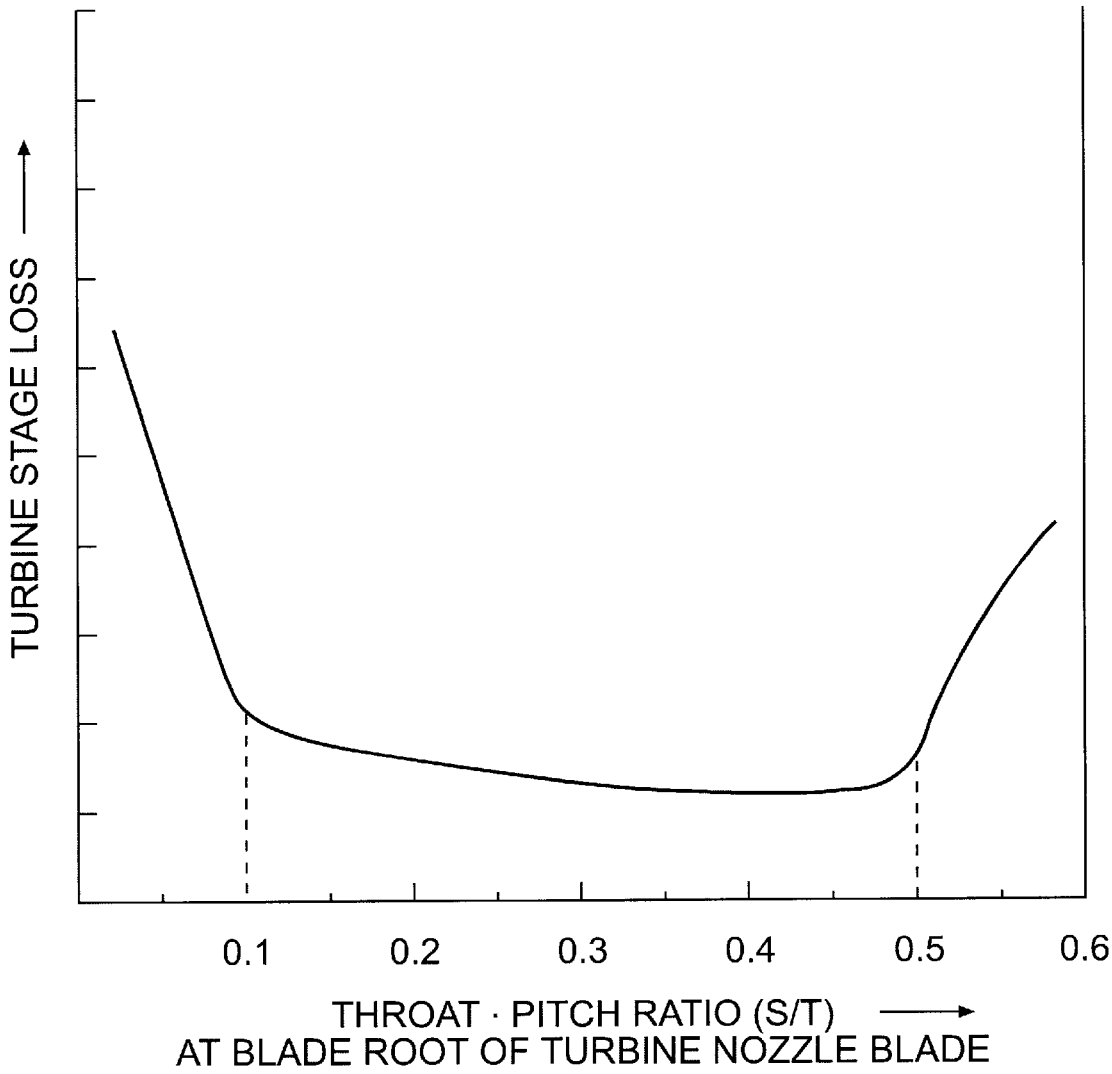
FIG. 8 is a turbine stage loss distribution graph showing the relationship between throat·pitch ratio (S/T) at the blade root and turbine stage loss for a turbine nozzle blade according to the present invention.

The about 0.1 to about 0.5 throat·pitch ratio (S/T) shown in FIG. 8 is the preferred application range obtained from a model turbine. If the throat·pitch ratios (S/T) at the blade root and the blade tip become too small, the rapid increase in loss occurs with the above-mentioned value as a boundary because the secondary (turbulent) flow loss close to the wall surface rapidly increases with this value as a boundary. Also, the flow distribution balance across the radial direction is upset causing an excessively large flow at the wall surface and rapidly increasing frictional loss close to the wall.

Figure 9:
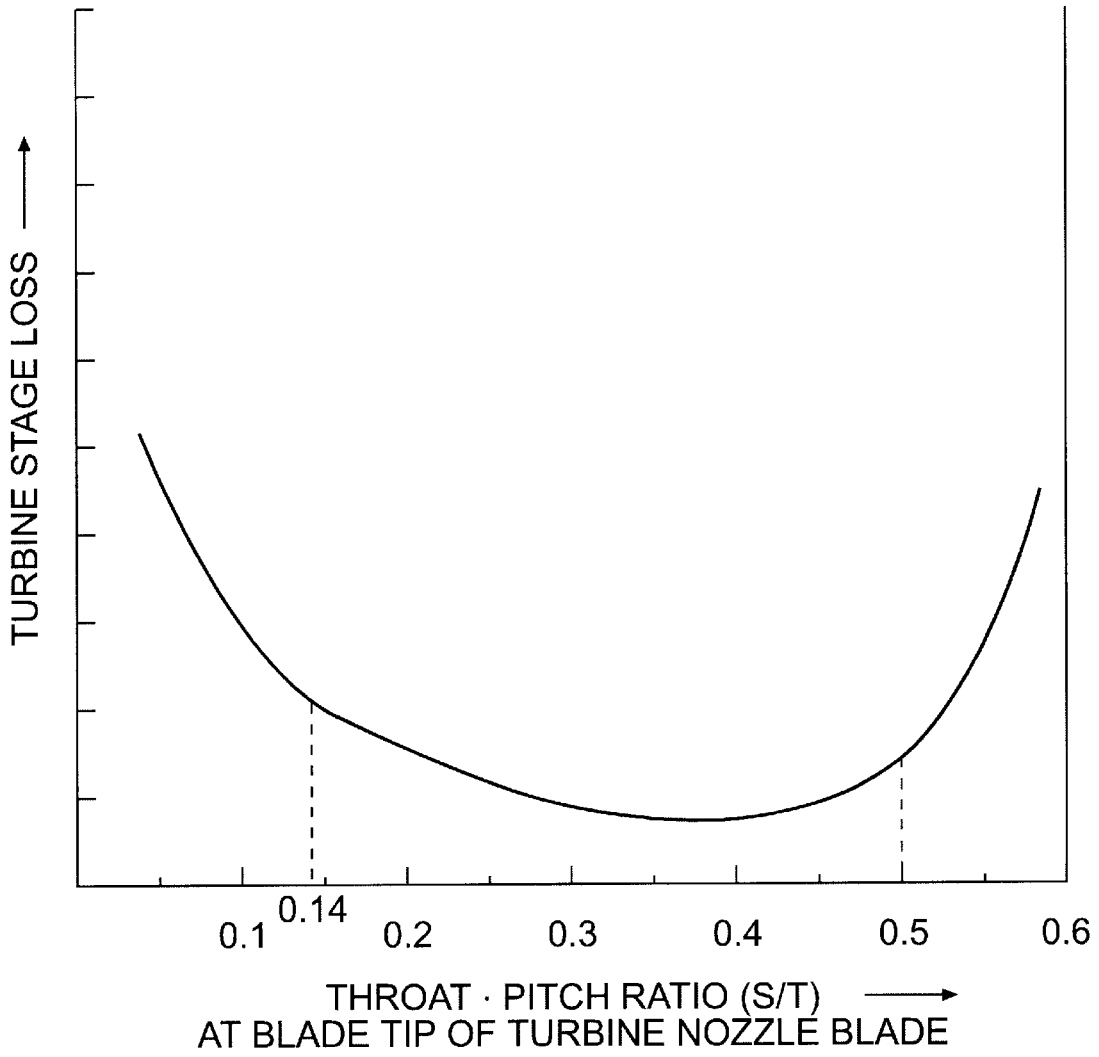
FIG. 9 is a turbine stage loss distribution graph showing the relationship between throat·pitch ratio (S/T) at the blade tip and turbine stage loss for a turbine nozzle blade according to the present invention.
Figure 10:
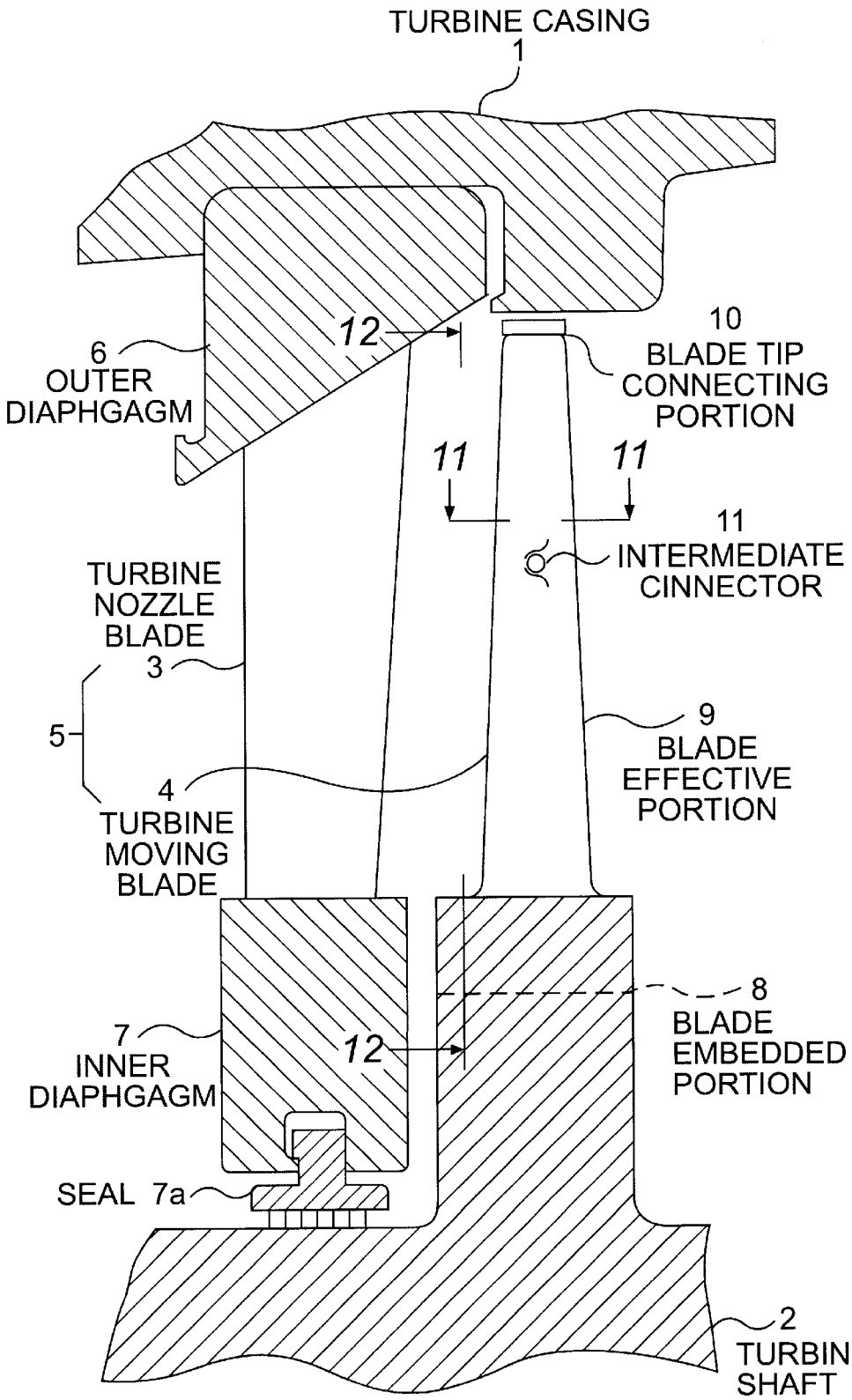
FIG. 10 PRIOR ART
FIG. 10 is a schematic sectional view showing a turbine nozzle blade and a turbine moving blade in a final turbine stage.

Setting the throat·pitch ratio (S/T) at the tip (blade height 100%) to about 0.14 to about 0.5 is based on the fact that, as shown in FIG. 9, the turbine stage loss will become smaller. This range of throat·pitch ratio (S/T) at the tip is the preferred application range, and similarly is obtained from a model turbine.

Summarizing this embodiment, the throat·pitch ratio (SIT) for turbine nozzle blades 20 is determined by giving a differential blade twist angle to the blade cross-sections such that the distribution of the throat·pitch ratio (S/T) is caused to swell outward, as if the maximal value were formed, within a blade height range of about 20% to about 80%. At the same time, the throat·pitch ratio (S/T) at the blade root (blade height 0%) is set in the range of about 0.1 to about 0.5, while the throat·pitch ratio (S/T) at the blade tip (blade height 100%) is set in the range of about 0.14 to about 0.5. Thus, more turbine driving steam is concentrated and caused to flow in the region where the turbine stage loss is small. Therefore, the turbine blade row performance can be even further improved over that of the prior art.

For the turbine nozzle blades, although adjustment of the blade twist angle is the most direct method for adjustment of the throat·pitch ratio (S/T), throat·pitch ratio (S/T) may also be adjusted by varying the curvature from the part that forms the suction surface throat to the trailing edge. That is, if the curvature of the part forming the back throat to the trailing edge is made smaller, the trailing edge will come closer to the back of the adjacent blade and the throat·pitch ratio (S/T) will become smaller. Conversely, if the curvature is made larger, the throat·pitch ratio (S/T) will become larger. Further, the throat·pitch ratio (S/T) can be adjusted by varying the trailing edge thickness. However, since the blade row performance will be reduced if the trailing edge is made thicker, it will be necessary to make other adjustments such that overall efficiency will be maintained.

In summary, for turbine moving blades assembled in a steam turbine according to the present invention, to compensate for the blade untwisting that occurs during operation, the distribution of the throat·pitch ratio (S/T) determined according to the differential blade twist angle, which is given to the blade cross-sections, is off-set so that it becomes larger than in the prior art and, during operation, the throat·pitch ratio (S/T) thus is maintained at an optimum value. Therefore, the turbine driving steam flows in a more stable state, and turbine blade row performance is improved.

For the turbine nozzle blades, the distribution of the throat·pitch ratio (S/T) determined according to the differential blade twist angle, which is given to the blade cross-sections, is made to swell in the outward direction as if the maximal value were formed. Thus, more turbine steam is concentrated and made to flow in the region where the turbine stage loss is small. Therefore, the turbine blade row performance can be even further improved over that of the prior art.

Obviously, numerous modifications and variations of the present invention are possible in view of the above teachings.

Japanese priority Application No. PH10-218262, filed on Jul. 31, 1998, including the specification, drawings, claims and abstract, is hereby incorporated by reference.

What is claimed is:

1. In a turbine moving blade assembly for a steam turbine which has a plurality of stages each provided with turbine moving blades attached to a turbine shaft and fixed turbine nozzle blades positioned axially adjacent the turbine moving blades, the turbine moving blades being circumferentially spaced with adjacent turbine moving blades being interconnected intermediate their ends and also at their radially outer tips, each of the turbine moving blades being twisted from the blade root to the blade tip, the improvement wherein the twist angles at blade cross-sections along the height of each turbine moving blade are differentially twisted to produce a distribution of throat·pitch ratio (S/T) along the turbine moving blade height direction from the blade root to the blade tip that follows a curve having at least one minimum and one maximum, wherein said minimum is located in the turbine moving blade height range of about 10% to about 20%, and the maximum is located in the turbine moving blade height range of about 25% to about 35%.

2. A turbine moving blade assembly according to claim 1, wherein said throat-pitch ratio (S/T) distribution is off-set to take into account turbine moving blade untwisting that occurs during operation of the steam turbine due to centrifugal force.

3. In a turbine moving blade assembly for a steam turbine which has a plurality of stages each provided with turbine moving blades attached to a turbine shaft and fixed turbine nozzle blades positioned axially adjacent the turbine moving blades, the turbine moving blades being circumferentially spaced with adjacent turbine moving blades being interconnected intermediate their ends and also at their radially outer tips, each of the turbine moving blades being twisted from the blade root to the blade tip, the improvement wherein the twist angles at blade cross-sections along the height of each turbine moving blade are differentially twisted to produce a distribution of throat·pitch ratio (S/T) along the turbine moving blade height direction from the blade root to the blade tip that follows a curve having at least one minimum and one maximum, wherein some of the differential blade twist angles are given to blade cross-sections in a clock-wise direction, and some of the differential twist angles are given to blade cross-sections in an anti-clockwise direction.

4. A turbine moving blade assembly according to claim 3, wherein said throat-pitch ratio (S/T) distribution is off-set to take into account turbine moving blade untwisting that occurs during operation of the steam turbine due to centrifugal force.

5. A turbine moving blade assembly according to claim 3 or claim 4, wherein the differential blade twist angles given in a clockwise direction are in positions in a turbine moving blade height range from about 0% to about 15%, and in positions in a turbine moving blade height range of about 85%, while the differential blade twist angles given in an anti-clockwise direction are at about 30% blade height position and at about 100% blade height position.

6. In a steam turbine having a casing, a shaft rotatable in the casing and a plurality of stages each provided with turbine moving blades attached to the turbine shaft and fixed turbine nozzle blades positioned axially adjacent the turbine moving blades, the turbine moving blades being circumferentially spaced with adjacent turbine moving blades interconnected intermediate their ends and also at their radially outer tips, each of the turbine moving blades being twisted from the blade root to the blade tip, the improvement wherein the twist angles at blade cross-sections along the height of each turbine moving blade are differentially twisted to produce a distribution of throat·pitch ratio (S/T) along the turbine moving blade height direction from the blade root to the blade tip that follows a curve having at least one minimum and one maximum, wherein said minimum is located in the turbine moving blade height range of about 10% to about 20%, and the maximum is located in the turbine moving blade height range of about 25% to about 35%.

7. A steam turbine according to claim 6, wherein said throat-pitch ratio (S/T) distribution is off-set to take into account turbine moving blade untwisting that occurs during operation of the steam turbine due to centrifugal force.

8. In a steam turbine having a casing, a shaft rotatable in the casing and a plurality of stages each provided with turbine moving blades attached to the turbine shaft and fixed turbine nozzle blades positioned axially adjacent the turbine moving blades, the turbine moving blades being circumferentially spaced with adjacent turbine moving blades interconnected intermediate their ends and also at their radially outer tips, each of the turbine moving blades being twisted from the blade root to the blade tip, the improvement wherein the twist angles at blade cross-sections along the height of each turbine moving blade are differentially twisted to produce a distribution of throat·pitch ratio (S/T) along the turbine moving blade height direction from the blade root to the blade tip that follows a curve having at least one minimum and one maximum, wherein some of the differential blade twist angles are given to blade cross-sections in a clock-wise direction, and some of the differential twist angles are given to blade cross-sections in an anti-clockwise direction.

9. A steam turbine according to claim 8, wherein said throat-pitch ratio (S/T) distribution is off-set to take into account turbine moving blade untwisting that occurs during operation of the steam turbine due to centrifugal force.

* * * * *